US007427066B1

(12) United States Patent
Goodwin

(10) Patent No.: US 7,427,066 B1
(45) **Date of Patent: *Sep. 23, 2008**

(54) PUZZLE APPARATUS WITH AUDIBLE SOUNDS

(75) Inventor: Richard P. Goodwin, Bristol, TN (US)

(73) Assignee: Fenwick Enterprises LLC, Blountville, TN (US)

( * ) Notice: Subject to any disclaimer, the term of this patent is extended or adjusted under 35 U.S.C. 154(b) by 482 days.

This patent is subject to a terminal disclaimer.

(21) Appl. No.: 11/253,995

(22) Filed: Oct. 19, 2005

Related U.S. Application Data

(63) Continuation-in-part of application No. 10/863,108, filed on Jun. 8, 2004, now Pat. No. 6,979,245.

(51) Int. Cl.
*A63F 7/04* (2006.01)

(52) U.S. Cl. ..... 273/153 R; 446/175

(58) Field of Classification Search ..... 273/153 R, 273/156, 157 R, 157 A; 434/317; 446/397
See application file for complete search history.

(56) References Cited

U.S. PATENT DOCUMENTS 5,413,486 A * 5/1995 Burrows et al. ..... 434/317
2002/0111203 A1* 8/2002 Chi ..... 463/9
2003/0162160 A1* 8/2003 Horchler et al. ..... 434/406
2005/0049023 A1* 3/2005 Foster ..... 463/9

OTHER PUBLICATIONS

U.S. Appl. No. 10/863,108, Richard P. Goodwin.

* cited by examiner

*Primary Examiner*—Robert E Pezzuto
*Assistant Examiner*—Alex F. R. P. Rada, II
(74) *Attorney, Agent, or Firm*—G. Brian Pingel; Camille L. Urban

(57) ABSTRACT

A puzzle apparatus comprising a first plurality of puzzle blocks that form a distinct visual representation per side when combined together that includes a representation of at least one cartoon character, a magnet associated with each side of the puzzle blocks, a platform on which the puzzle blocks can be arranged, a detector for sensing the magnet and sound generating apparatus for producing audible sounds corresponding to the character shown on the puzzle blocks. A second magnet and sensor determines the proper orientation of each puzzle block.

17 Claims, 7 Drawing Sheets

PUZZLE APPARATUS WITH AUDIBLE SOUNDS

CROSS REFERENCE

This is a Continuation-In-Part of application Ser. No. 10/863,108 filed Jun. 8, 2004 now U.S. Pat. No. 6,979,245.

BACKGROUND OF THE INVENTION

1. Field of the Invention

The present invention relates in general to a puzzle apparatus that includes a number of puzzles that can each be arranged, one-at-a-time, on a platform of a housing and more specifically involves the use of sound producing means associated with the platform for producing audible sounds representative of characters shown on each of the puzzles.

2. Description of Related Art

A variety of different types of puzzles are known in the prior art which serve to provide an intellectually challenging test of a user's skill in being able to arrange puzzle pieces together to form a completed picture. Applicant's application Ser. No. 10/863,108 improved the art by providing a means for producing a variety of sayings that are associated with characters shown in puzzles such as well-known cartoon characters. Once the puzzle pieces of the puzzle were properly arranged on a platform, a user could select and activate a sound producing assembly that will provide an audible saying associated with one of the characters shown on the puzzle. The puzzle pieces of different sets of puzzles, however, could become intermixed and result in unexpected combinations. There is therefore a need to have a puzzle apparatus providing a variety of sayings with multiple puzzles but not requiring multiple sets of puzzle pieces.

SUMMARY OF THE INVENTION

The present invention provides a puzzle apparatus having at least a first plurality of puzzle blocks that form a picture on each side of the blocks that includes a representation of at least a first audible sound producing means, first and second detectible means associated with at least one of the puzzle blocks, a platform on which the puzzle blocks can be arranged, first and second detection means associated with the platform for sensing the detectible means and a sound means for producing audible sounds that are related to the various sound producing representations that may be shown in the puzzle picture. The first detection means discerns which puzzle the user is solving and whether a block placed on the platform is in the correct position. If the block's position is incorrect, an audible or visual signal may be provided to the user. The second detection means discerns whether the block is in the correct orientation and if it is not, another audible or visual signal may be provided.

In a first preferred embodiment, the apparatus includes a housing having a top surface that included the platform on which the puzzle blocks can be arranged and the sound means includes a plurality of actuators that can be engaged as desired by a user to produce a variety of audible sounds that are associated with representations of characters or other types of sound producing means that are shown on the picture produced by the puzzle blocks. Preferably, each picture formed by the puzzle blocks includes a plurality of representations of characters or other audible sound producing means and the sound means is designed to allow a user to select the playing of audible sounds that form a story or other material that is expressed in the voices of the characters depicted.

The apparatus is designed to include a variety of different puzzle blocks to form multiple pictures, each with different representations of characters on them. The puzzle blocks for each picture include detectible means that differ from picture-to-picture, i.e. each side of the blocks has different placement of detection means, to differentiate one picture from the other and the housing platform includes a detection means that is able to sense the detectible means on each picture and provide an output representative of the particular picture that is arranged on the platform. The housing further includes a plurality of actuators that are each associated with one of the characters shown in the picture. Thus, when one of the actuators is engaged by a user, the apparatus will provide an audible saying of the actuator's associated character shown on the particular picture then located on the platform. In a second embodiment, four first detection means corresponding to each corner of the blocks are used to detect the pattern of first detectible means on the blocks. In a third embodiment, the puzzle apparatus automatically provides an audible saying in response to incorrectly placing a block and solving the puzzle.

The foregoing and other advantages of the present invention will appear from the following description. In the description, reference is made to the accompanying drawings, which form a part hereof, and in which there is shown by illustration and not of limitation a specific form in which the invention may be embodied. Such embodiment does not represent the full scope of the invention, but rather the invention may be employed in a variety of other embodiments and reference is made to the claims herein for interpreting the breadth of the invention.

DETAILED DESCRIPTION OF THE PREFERRED EMBODIMENT

Figure 1:
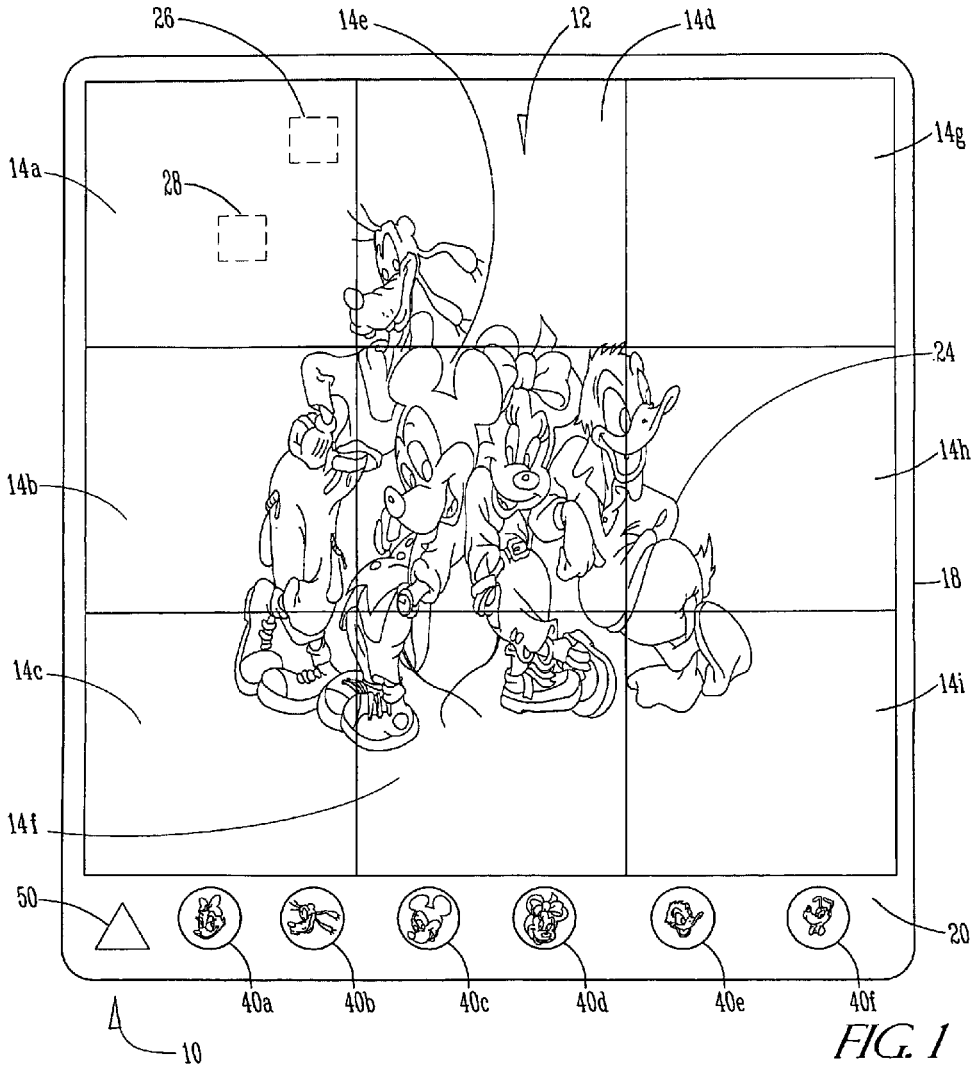
FIG. 1 is a plan view of a first preferred embodiment of the puzzle apparatus of the present invention that includes a plurality of puzzle blocks that form a picture.
Figure 2:
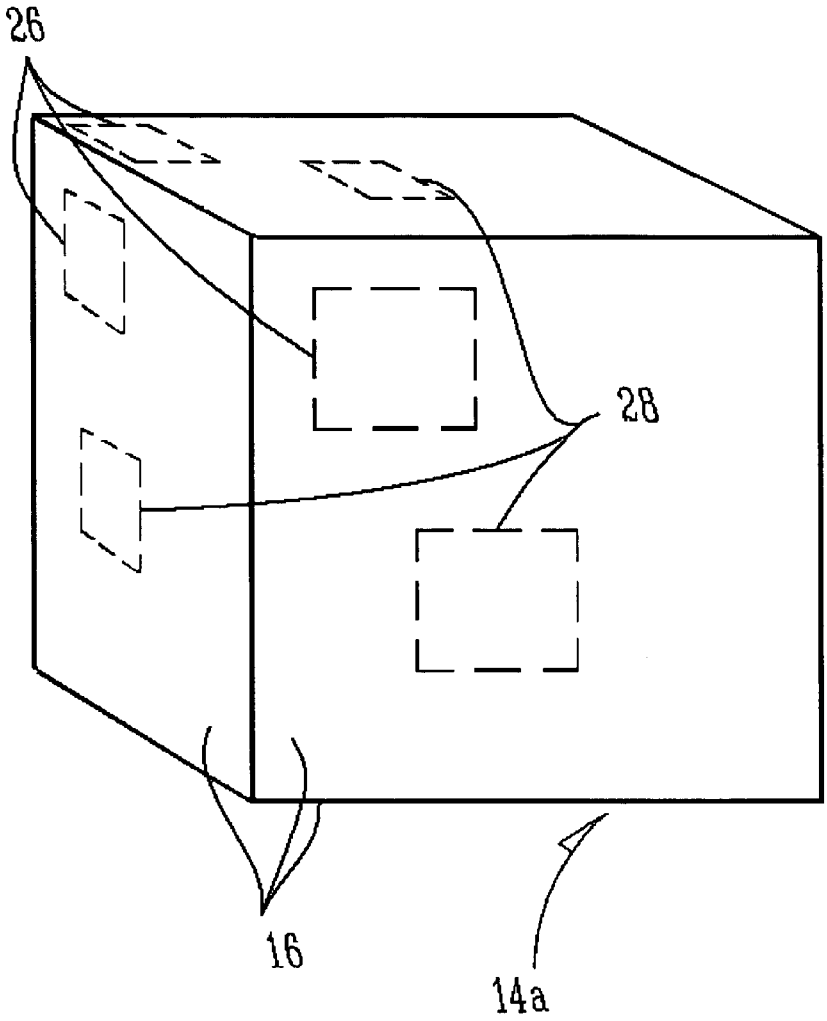
FIG. 2 is a perspective view of a puzzle block of the first preferred embodiment.

The following description is provided with reference to the drawings beginning first with FIG. 1 in which a first preferred embodiment of a puzzle apparatus of the present invention is shown generally at 10 and is designed to provide not only an enjoyable and challenging experience for young children, but also serves as an entertainment device for them. The apparatus 10 is designed to include a plurality of puzzles such as a puzzle 12 as shown that is formed from a plurality of puzzle blocks 14*a-i*. As seen in FIG. 2, each block 14*a-i* of the first preferred embodiment has multiple sides 16 that form the puzzle 12. Each block 14*a-i* is a cube with six of sides 16 such that the blocks 14*a-i* can firm six of puzzle 12. The block 14*a* shown in FIG. 2 is representative of all blocks of the first preferred embodiment.

Figure 3:
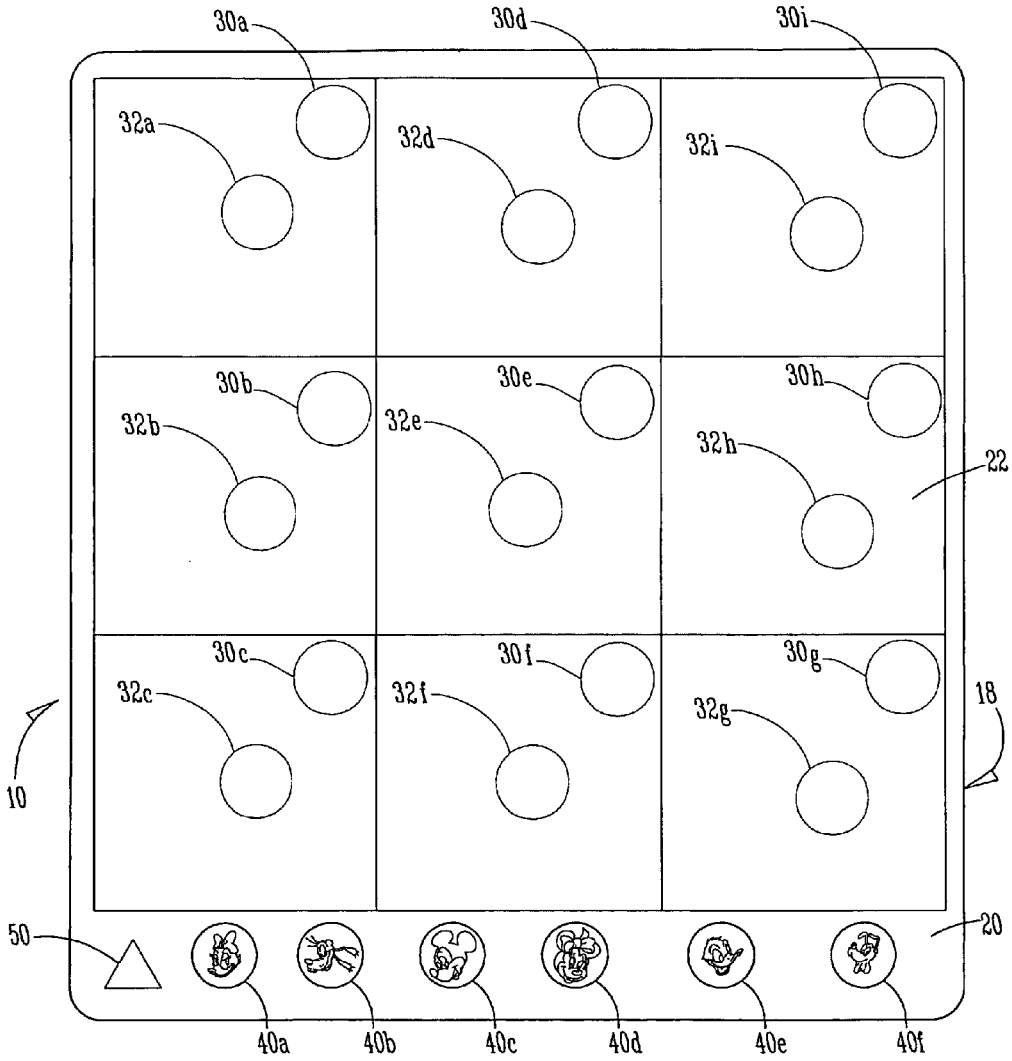
FIG. 3 is a plan view similar to that of FIG. 1, but with the puzzle blocks removed therefrom.
Figure 4:
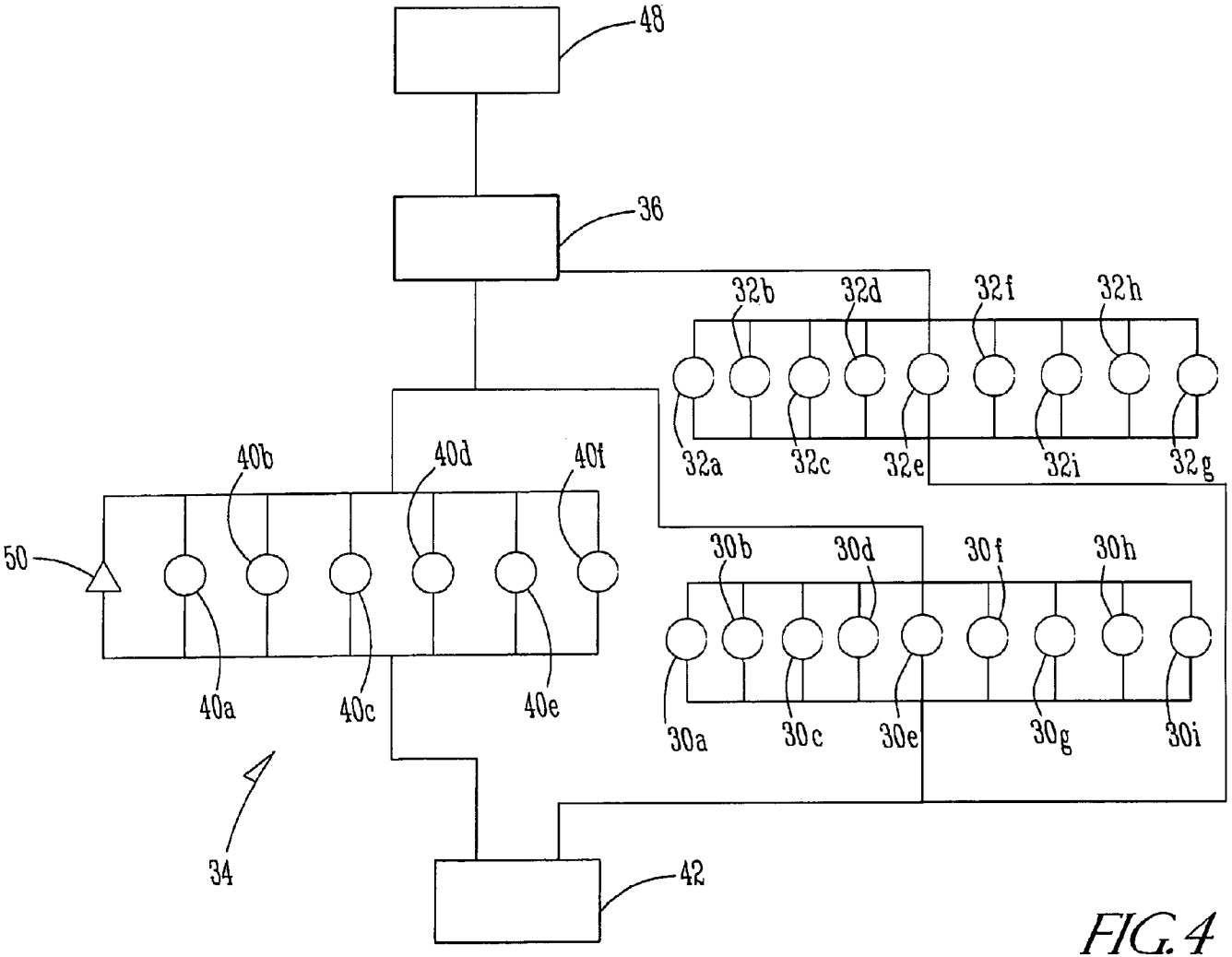
FIG. 4 is a block diagram of the electronic circuitry useable in the embodiment of FIG. 1.

Referring now to FIGS. 1, 3 and 4, the apparatus 10 includes a relatively thin rectangularly shaped housing 18 having a top surface 20 with a recessed platform portion 22 in which all of the sides 16 of the puzzle blocks 14*a-i* are to be arranged to form a distinct visual representation 24. Except for the particular sections of the distinct visual representation 24 they each contain per side 16, the puzzle blocks 14*a-i* are essentially the same. Each of the puzzle blocks 14*a-i* includes preferably a first detectible means 26 and a second detectible means 28. Both detectible means 26 and 28 are magnetic strips in the preferred embodiment. The platform 22 has corresponding first detection means 30*a-i* and second detection means 32*a-i*. The detection means 30*a-i* and 32*a-i* are arranged on the platform 22 to correspond to each block 12*a-l* as seen in FIG. 3. The detection means 30*a-i* and 32*a-i* are preferably magnetic sensors embedded in the platform 22. The placement of detectible means 26 and 28 on the block 14*a* as they align with detection means 30*a* and 32*a* is illustrated by the dotted lines in FIG. 1, but the corresponding placement of detectible means and detection means is the same for all of the blocks 14*a-i* and detection means 30*a-i* and 32*a-i*.

The first and second detection means 30*a-i* and 32*a-i* are included as part of an electronic circuit 34, as shown in FIG. 4 that is contained within the housing 18. Thus, when the puzzle blocks 14*a-i* are properly arranged together on the platform portion 22, the first and second detection means 30*a-i* and 32*a-i* detect the first and second detectible means 26 and 28 in the puzzle blocks 14*a* and *b* and provide output signals in response to such detection to a printed circuit 36 that preferably includes a central processing unit 38 (not shown).

Figure 5:
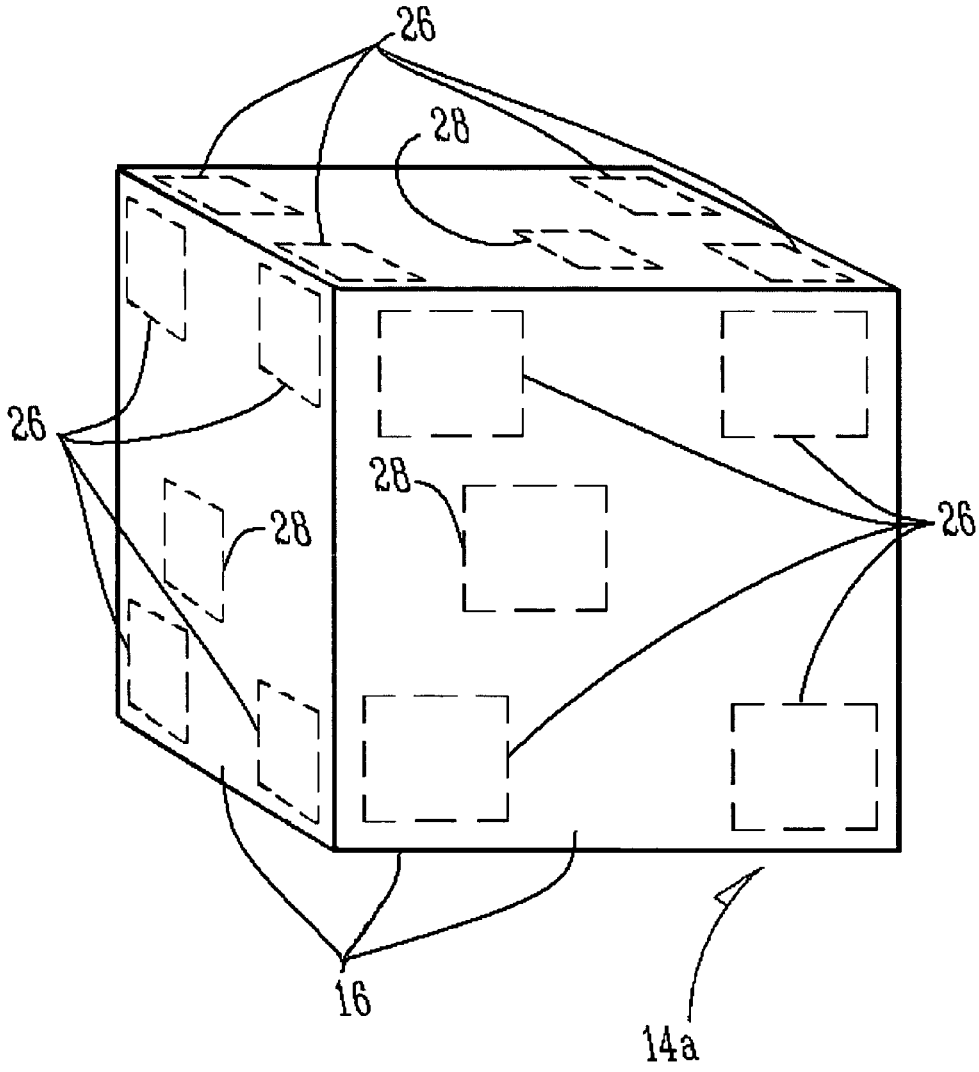
FIG. 5 is a perspective view of a puzzle block of the second preferred embodiment.
Figure 6:
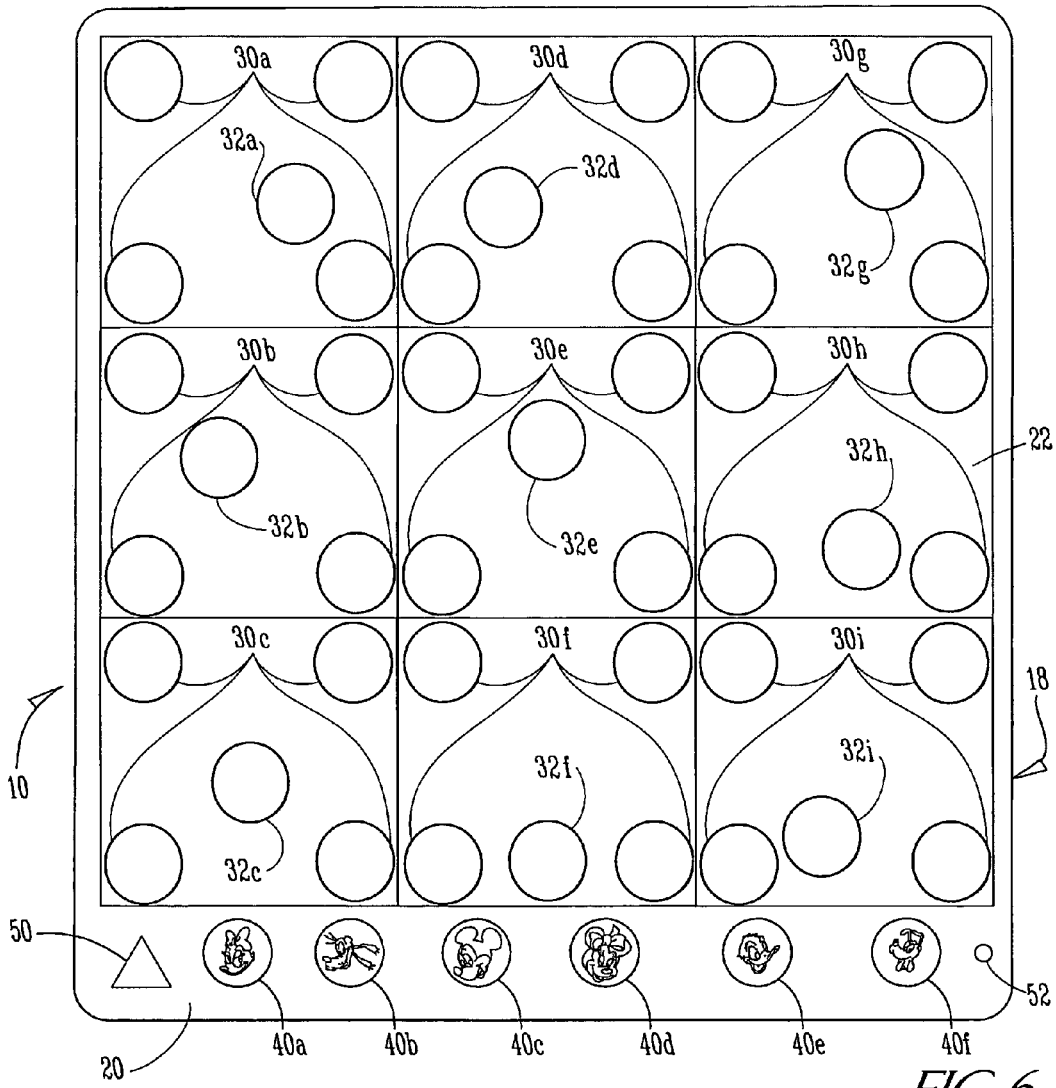
FIG. 6 is a plan view of a of a second preferred embodiment of a puzzle apparatus with the puzzle blocks removed therefrom.
Figure 7:
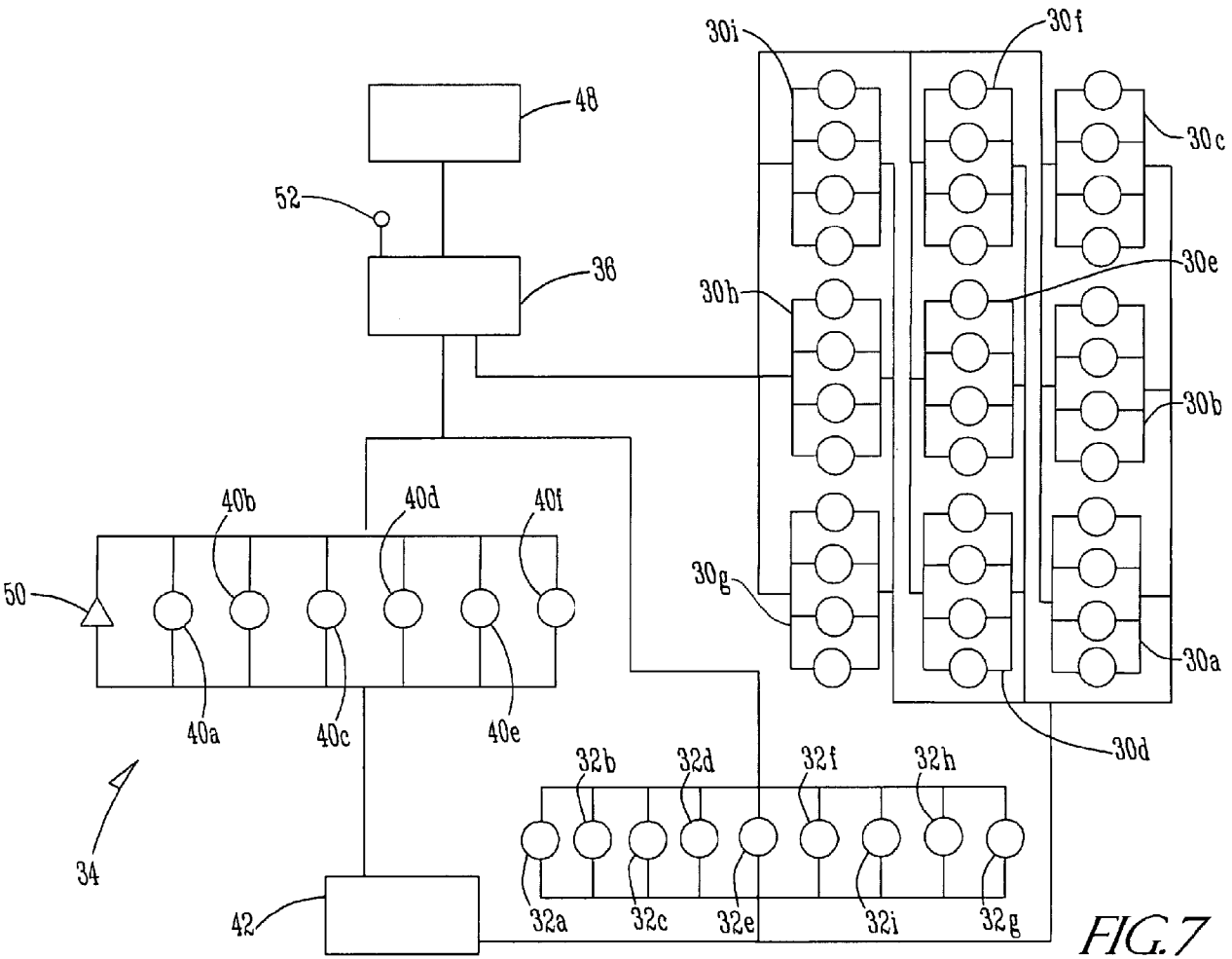
FIG. 7 is a block diagram of the electronic circuitry useable in the embodiment of FIG. 6.

Based upon the output signals sent in the manner described above, the CPU 38 is programmed to recognize that the puzzle 12 is arranged on the platform portion 22. Similarly, each side 16 of the blocks 14*a-i* has its own puzzle 12 used with the apparatus 10, and the first detectible means 26 on each side is different depending upon the puzzle 12. In this way, the apparatus 10 is able to discern the particular type of puzzle that is arranged in the platform portion 22. To ensure that the blocks 14*a-i* are properly oriented, the second detectible means 28 is placed such that it will only align with one of the detection means 32*a-i* only when properly oriented. However, it should be recognized by those skilled in the art that there are other methods that could be used for differentiating between the puzzles rather than through the use of the magnetic strips 26. For example, each detection means could be an open circuit closed by a conduction strip As shown in FIGS. 5, 6, and 7, the second preferred embodiment uses four magnetic strips for the first detection means 30*a-i* to correspond to each of the blocks a-i. The pattern of first detectible means 26 on each side 16 of each block 14*a-i* determines the puzzle 12. By locating the detectible means 26 in the corners of each side 16 and using the second detectible means 28 to determine orientation as in the first embodiment, there is no chance that the puzzle 12 can be solved without correctly arranging the blocks 14 *a-i* to form the distinct visual representation 24.

Referring again to FIG. 1, the distinct visual representation 24 includes a representation of four audible sound producing means in the form of the cartoon characters, Goofy, Mickey Mouse, Minnie Mouse and Donald Duck. Directly beneath the platform portion 22 are six longitudinally aligned actuator buttons 40*a-f* serving as a plurality of actuators that are preferably pressure or touch sensitive and contain a depiction of the head of a cartoon character, with the buttons 40*b-e* having the heads of the cartoon characters shown in the distinct visual representation 24.

The electronic circuit 34 is preferably powered by battery power supply 42 as shown in FIG. 5 and is designed so that when one of the actuator buttons 40*b-e* is pressed by a user, a voice chip 44 (not shown) in the printed circuit 36 will produce electronic signals representative of a saying by the cartoon character depicted on the button pressed, which signals are provided to a speaker 48 that audibly reproduces such signals. Preferably, the saying that is rendered will be related to the activity of the characters that is shown in the distinct visual representation 24 and may well consist of a story. Thus, pressing of the actuator buttons 40*b-e* one-at-a-time produces a saying by each one of the cartoon characters shown in the distinct visual representation 24. Alternatively, rather than having the characters depicted on the buttons 40*a-f* provide a narration, the housing 18 includes a triangular shaped master actuator button 50 that, when pushed provides a complete narration of the material that would otherwise be rendered. In a third embodiment, the saying is automatically produced upon completion of the puzzle 12 or if one of the blocks 14*a-i* is improperly placed on the platform 22, an audible or visual signal is provided to the user. Such visual signal can be in a variety of form but in this third embodiment it is simply a light 52 as indicated in FIGS. 6 and 7.

Because the cartoon characters depicted on the buttons 40*a* and *f* are not included in the distinct visual representation 24, preferably such characters will not have a saying associated with them for the distinct visual representation 24. However, it is envisioned that other puzzles to be used with the apparatus 10 will include a different selection of the cartoon characters depicted on the actuator buttons 40*a-f*, and will show the cartoon characters involved in different activities so that the voice chip 44 will produce different sayings from those produced for the puzzle 12. Furthermore, the use of cartoon characters is not critical to the present invention as any audible sound producing means may be depicted on the puzzle 12 such as animals or musical instruments, etc. Additionally, the apparatus 10 can be adapted to include other sets of characters and associated puzzles simply through the use of covers that can be placed on the actuator buttons 40*a-f*. Such covers would include the depiction of the puzzle characters rather than the buttons 40*a-f*. Also the CPU 38 would have to be programmed to recognize two or more different sets of puzzles with different characters or the apparatus could employ replaceable cartridges that would be used for the various puzzle sets.

Thus, the present invention provides a novel and unique means for supplying a user with the challenge of having to properly put a puzzle together and then supplies an entertaining version of a description of the activity involved on a distinct visual representation contained on a puzzle. Although the puzzle apparatus of the present invention has been described with respect to a preferred embodiment, it should be understood that such embodiment may be altered without avoiding the true spirit and scope of the present invention. For example, a wide variety of electronic circuitry can be substituted for the circuitry 34 and the puzzles employed with the apparatus 10 may contain a large plurality of different types of characters, musical instruments, machines or other types of audible sound producing means.

What is claimed is:

1. A puzzle apparatus comprising:

(a) a plurality of removable puzzle blocks having at least two sides forming a distinct visual representation per side when said blocks are properly arranged (b) said visual representation is associated with at least one audible sound producing means;

(c) at least one first detectible means associated with each of said plurality of puzzle blocks;

(d) a platform having a surface on which said puzzle blocks can be arranged;

(e) at least one first detection means associated with said platform and adapted for sensing said at least one first detectible means and providing a first output signal that is representative of each side of said first plurality of puzzle blocks;

(f) at least one second detectible means associated with each of said plurality of puzzle blocks;

(g) at least one second detection means associated with said platform and adapted for sensing said at least one second detectible means, and providing a second output signal that is representative of each of said plurality of puzzle blocks;

(h) means for receiving said first output signal and said second output signal and activating said at least one sound producing means to produce a first audible sound associated with said visual representation; and (i) wherein said at least one first detection means and said at least one second detection means are incorporated on said surface of said platform and said first and second output signals provide an indication to a user that each of said blocks is correctly arranged on said platform.

2. The puzzle apparatus as described in claim 1, wherein each of said second detectible means is located on each side of said puzzle blocks to define an orientation and said second detection means detects said orientation and describes said orientation in said second output signal.

3. The puzzle apparatus as described in claim 2, wherein four of said first detection means correspond to each of said blocks and are arranged on said platform to correspond to each corner of each of said blocks and one of said second detection means corresponds to each of said blocks and is located among each of said four of said first detection means such that said detection means can only detect said second detectible means when said block is properly oriented.

4. The puzzle apparatus as described in claim 3, wherein said first detectible means defines a puzzle represented by said visual representation and said first detectible means describes said puzzle in said first output signal such that said apparatus can sense the particular puzzle arranged on said platform and will provide different audible sounds for each of said puzzles.

5. The puzzle apparatus as described in claim 4, wherein said sound means comprises:

(a) a plurality of actuators designed to be individually actuated by a user as desired;

(b) electronic circuitry for producing output signals corresponding to said audible sound producing means and said orientation; and (c) means for receiving said electronic signals and producing audible sounds corresponding to such signals.

6. The puzzle apparatus as described in claim 5, wherein said sound producing means is adapted to automatically produce a specific audible sound in response to properly arranging said blocks on said platform to form said distinct visual representation.

7. The puzzle apparatus as described in claim 5, wherein said distinct visual representation includes a plurality of representations of said audible sound producing means and said sound means is adapted to produce specific audible sounds representative of each of said audible sound producing means.

8. The puzzle apparatus as described in claim 7, wherein each of said actuators is associated with one of the plurality of representations of said audible sound producing means so that when a particular one of said actuators is activated by a user, the sound means will produce the specified audible sounds representative of said audible sound producing means.

9. The puzzle apparatus as described in claim 8, wherein said actuators are in the form of buttons that each have a symbol thereon that is related to one of the representations of said audible sound producing means.

10. The puzzle apparatus as described in claim 8, wherein said sound means further includes a master actuator to be actuated by a user to produce audible sounds representative of all of said audible sound producing means.

11. The puzzle apparatus as described in claim 8, wherein said sound means further includes a master actuator to be actuated by a user to produce audible sounds representative of a story.

12. The puzzle apparatus as described in claim 2, wherein one of said first detection means corresponds to each of said blocks and is arranged on said platform to correspond to a corner of each of said blocks and one of said second detection means is located proximate to each of said first detection means such that said detection means can only detect said second detectible means when said block is properly oriented.

13. The puzzle apparatus as described in claim 2, wherein said audible sound producing means produces a specific sound representative of said orientation.

14. The puzzle apparatus as described in claim 1, wherein each said visual representations associated with each side of said plurality of puzzle blocks includes representations of a plurality of audible sound producing means.

15. The puzzle apparatus as described in claim 1, wherein said platform is part of a housing in which electronic circuitry for said apparatus is contained.

16. The puzzle apparatus as described in claim 1, wherein said first and second detectible means is a magnetic strip and said first and second detection means is a magnetic sensor.

17. The puzzle apparatus as described in claim 1, wherein said first and second detectible means is a conductive strip and said first and second detection means is an open circuit closed by said conductive strip.

* * * * *